US009957099B2

(12) United States Patent
White et al.

(10) Patent No.: US 9,957,099 B2
(45) Date of Patent: May 1, 2018

(54) INSULATED CONTAINER SYSTEM FOR MAINTAINING A CONTROLLED PAYLOAD TEMPERATURE

(71) Applicant: Nanopore, Inc., Albuquerque, NM (US)

(72) Inventors: Wendy White, Albuquerque, NM (US); Ronald Esparza, Albuquerque, NM (US); Douglas M. Smith, Albuquerque, NM (US)

(73) Assignee: Nanopore, Inc., Albuquerque, NM (US)

( * ) Notice: Subject to any disclaimer, the term of this patent is extended or adjusted under 35 U.S.C. 154(b) by 1183 days.

(21) Appl. No.: 14/096,992

(22) Filed: Dec. 4, 2013

(65) Prior Publication Data

US 2014/0151382 A1 Jun. 5, 2014

Related U.S. Application Data

(60) Provisional application No. 61/733,330, filed on Dec. 4, 2012.

(51) Int. Cl.
*F25D 3/08* (2006.01)
*B65D 81/38* (2006.01)

(52) U.S. Cl.
CPC ..... *B65D 81/3862* (2013.01)

(58) Field of Classification Search
CPC ..... B65D 81/3862; F25D 2201/12; F25D 2303/0821; F25D 2303/08; F25D 2201/00; F25D 2201/122; F25D 2201/124; F25D 2201/126; F25D 2201/1262; F25D 3/02; F25D 3/06; F25D 3/08
See application file for complete search history.

(56) References Cited

U.S. PATENT DOCUMENTS

| | | | | |
|---|---|---|---|---|
| 4,923,077 | A | 5/1990 | Van Iperen et al. | |
| 5,711,164 | A | 1/1998 | Slack | |
| 5,924,302 | A | 7/1999 | Derifield | |
| 6,295,830 | B1 * | 10/2001 | Newman | B65D 81/3823 62/371 |
| 6,325,281 | B1 | 12/2001 | Grogan | |
| 6,502,417 | B2 | 1/2003 | Gano, III | |
| 6,688,132 | B2 | 2/2004 | Smith et al. | |
| 7,028,504 | B2 * | 4/2006 | Derifield | B65D 81/3827 62/372 |
| 7,257,963 | B2 | 8/2007 | Mayer | |
| 7,721,566 | B1 | 5/2010 | Wilken | |
| 7,975,504 | B2 | 7/2011 | Whewell, Jr. | |
| 8,250,882 | B2 | 8/2012 | Mustafa et al. | |
| 2003/0082357 | A1 * | 5/2003 | Gokay | B32B 3/04 428/212 |
| 2004/0079793 | A1 | 4/2004 | Mayer | |

(Continued)

FOREIGN PATENT DOCUMENTS

WO 2007133805 A2 11/2007

*Primary Examiner* — Larry Furdge
(74) *Attorney, Agent, or Firm* — Marsh Fischmann & Breyfogle LLP

(57) ABSTRACT

An insulated container system and a temperature control insert that is configured to maintain a payload chamber temperature over a minimum length of time to enable goods within the payload chamber to be shipped over distances while being maintained within a desired temperature range.

36 Claims, 6 Drawing Sheets

(56) References Cited

U.S. PATENT DOCUMENTS

| | | | | |
|---|---|---|---|---|
| 2005/0042416 | A1* | 2/2005 | Blackmon | B32B 3/12 428/116 |
| 2005/0159282 | A1* | 7/2005 | Schoenberger | B65D 81/386 493/55 |
| 2005/0224501 | A1* | 10/2005 | Folkert | B65D 5/0236 220/592.2 |
| 2006/0099361 | A1* | 5/2006 | Jablonka | C09K 5/063 428/35.2 |
| 2011/0226440 | A1* | 9/2011 | Bissell | F28D 20/0039 165/10 |
| 2011/0277489 | A1* | 11/2011 | Schalla | A47B 31/02 62/89 |
| 2011/0290792 | A1* | 12/2011 | Krzak | B65D 81/3816 220/1.5 |

* cited by examiner

INSULATED CONTAINER SYSTEM FOR MAINTAINING A CONTROLLED PAYLOAD TEMPERATURE

RELATED APPLICATIONS

This application claims the priority benefit under 35 USC § 119(e) of U.S. Provisional Application No. 61/733,330, filed Dec. 4, 2012, which is incorporated herein by reference in its entirety.

FIELD

This disclosure relates to the field of controlled temperature packaging. In particular, this disclosure relates to the field of container systems for maintaining the temperature of goods disposed therein for a period of time, such as for shipment of the container from one location to another remote location.

BACKGROUND

The shipment of products that must have their temperature maintained within a specified temperature range is one of the fastest growing market segments in the modern shipping industry. This growth is driven by a number of factors including widespread concerns about safety in the cold food distribution chain, increasing numbers of pharmaceutical and life sciences products which must have their temperature maintained within certain limits, the rapid growth in high-value specialty chemicals such as those used in the semiconductor industry, the increasing number of sophisticated medical tests which require the shipment of patient specimens to an external laboratory, the increased number of clinical trials associated with new pharmaceutical discovery and the increased delivery of products directly to the customer as a result of Internet ordering.

This field is generally referred to as controlled temperature packaging (CTP). CTP can be segmented by the target temperature range, namely: frozen (e.g., below −15° C.); 2° C. to 8° C.; and less than ambient (e.g., less than 30° C.). Controlled temperature packaging may also encompass targeted temperatures in the ambient range (e.g., 15° C. to 30° C.), or above ambient, such as about 37° C. (e.g., human body temperature). Other specialty applications require different temperature ranges, such as specialty ice cream (e.g., below −40° C.), swine semen (e.g., 15° C. to 19° C.), and high end chocolates (e.g., 12° C. to 18° C.) as examples.

In addition, CTP may be segmented by container size, for example: greater than pallet; one cubic foot to pallet; and less than one cubic foot. Containers having a size greater than pallet are typically cooled or heated mechanically and the shipment times are typically from days to many weeks. The one cubic foot to pallet size segment is dominated by systems using ice and/or thermally conditioned (e.g., cooled) water in the form of gel packs and/or dry ice as a coolant. Gel packs typically include a small quantity of super absorbent polymer (SAP) or carboxymethylcellulose (CMC) that is added to the water to dramatically increase its viscosity to help keep the shape of the pack and to reduce leakage. The containers are typically insulated using expanded polystyrene (EPS) or polyurethane (PU). The market segment for containers less than one cubic foot in size has been limited due to the inability of EPS and PU systems to maintain uniform temperatures in this size range except for very short durations (e.g., less than one day). The problem is especially difficult for products which are not frozen and require both cold and hot side protection, e.g., that must be kept within a specific temperature range.

Although many basic ice/EPS systems are in use for cooling shipping containers, there is a wide variation in quality and performance of the packaging depending on the value of the product and the sensitivity of the product to temperature fluctuation. A relatively simple system includes a cardboard box into which EPS sheet has been cut and placed. The container is then filled with dry ice in which, for example, frozen fish is shipped. A more sophisticated approach is a validated system consisting of custom molded EPS forms in a rigid box with both frozen and thermally conditioned gel packs, the combination of which has been tested through a range of temperature cycles for specified thermal properties. Such a validated system can be used for shipping pharmaceuticals. For example, many pharmaceutical products, such as vaccines and antibodies, must be maintained at 2° C. to 8° C.

An example of the foregoing system is illustrated in U.S. Pat. No. 5,924,302 by Derifield issued on Jul. 20, 1999. This patent illustrates a shipping container that includes a plurality of cavities adapted to receive a coolant (e.g., gel packs) that surround a chamber that is adapted to receive an item to be shipped.

SUMMARY

Several known insulated container systems suffer from one or more drawbacks that limit their widespread application. For example, some systems must utilize dry ice ($CO_2$) for cooling. However, the use of dry ice is often subject a surcharge and its use in air transport is severely regulated due to the possibility of an explosion caused by the expanding gas. As another example, some systems require the use of coolant symmetry, i.e., where a coolant is symmetrically disposed about the payload chamber. This complicates the container system by requiring the use of several coolant elements.

There is a need for a simplified insulated container system that is configured to maintain the temperature of a product(s) disposed within a payload chamber for a definite period of time, e.g., at least about 24 hours and not greater than about 120 hours.

In one embodiment, an insulated container system for maintaining a controlled payload temperature over a period of time is provided. The insulated container system may include an external carton having a sidewall structure extending from a bottom carton wall to a top carton wall, and defining an enclosure bounded by the sidewall structure, the bottom carton wall and the top carton wall. A sidewall insulative layer may be disposed within the enclosure and along the sidewall structure, and a bottom insulative layer may be disposed within the enclosure and along the bottom carton wall. A payload chamber is bounded by the sidewall insulative layer and bottom insulative layer and a top insulative layer may be operatively disposed over the payload chamber. A temperature control insert is operatively disposed between the top insulative layer and the payload chamber, wherein the temperature control insert includes a tray and at least a first phase change material that is sealed within the tray, the tray having a working surface facing the payload chamber, the working surface having at least a first portion that extends into the payload chamber by a greater distance than a second portion of the working surface.

In one characterization, the external carton is a corrugated cardboard box, and may be a regular slotted container (RSC). The sidewall structure may include four sidewall elements, e.g., where the external carton has a rectangular cross-section.

The insulative layers may include high performance insulative panels. In one characterization, at least the sidewall insulative layer comprises a high performance insulation panel having a thermal resistance of at least about 1.5 $m^2 \cdot K/W$. In another characterization, at least the bottom insulative layer includes a high performance insulation panel having a thermal resistance of at least about 2 $m^2 \cdot K/W$. For example, at least one of the sidewall insulative layer and the bottom insulative layer may include a vacuum insulation panel. Further, the top insulative layer may also include a high performance insulative panel, such as a vacuum insulation panel.

In a further characterization, the working surface of the temperature control insert may comprise a rigid or semi-rigid thermoformed structure, such as where the working surface is fabricated (e.g., thermoformed) from a plastic sheet. In one particular characterization, the working surface is fabricated from polyethylene terephthalate (PET).

In another characterization, the working surface includes a plurality of projections extending toward the payload chamber. For example, the projections may extend inwardly toward the payload chamber by a depth of at least about 10 mm. In another characterization, the working surface may have a surface area factor (described below) of at least about 1.05.

The first phase-change material can include an aqueous-based gel, for example. In another characterization, the first phase-change material has a transition temperature of not greater than about 0° C., such as not greater than about −20° C. In another characterization, the first phase change material has a transition temperature of at least about 5° C., such as at least about 15° C. or even at least about 25° C.

In another characterization, at least a second phase change material is sealed within the tray.

In a further characterization, the temperature control insert includes an outer peripheral edge that is disposed between an upper edge of the sidewall insulative layer and the top insulative layer to secure the temperature control insert therebetween. A first cushioning layer may be disposed between the upper edge of the sidewall insulative layer and the outer peripheral edge of the temperature control insert. Further, a second cushioning layer may be disposed between the outer peripheral edge of the temperature control insert and the top insulative layer. The first and second cushioning layers may comprise polymer foam, for example.

In another embodiment, a temperature control insert that is configured for placement in an insulated container is provided. The temperature control insert may include a volume of first phase change material and a volume of second phase change material that is discrete from the volume of first phase change material, wherein at least one of the composition or the phase state of the second phase change material is different than the first phase change material.

In one characterization, the first phase change material is a liquid at a starting temperature and the second phase change material is a solid at the starting temperature. In another characterization, the first phase change material is a super-cooled liquid at the starting temperature. In yet another characterization, the first and second phase change materials are the same or substantially the same material.

DETAILED DESCRIPTION

The present disclosure is directed to an insulated container system and the components of an insulated container system, including a temperature control insert. The insulated container system is configured for maintaining a controlled payload temperature (e.g., within the insulated container) over a minimum period of time, such as up to about 48 hours, up to about 72 hours, up to about 96 hours or even up to about 120 hours, for example. The insulated container system is particularly useful as a shipping container wherein goods disposed within the payload chamber must be maintained within a specified temperature range during the shipment of the goods. The insulated container system includes insulative layers (e.g., of high performance insulation panels), surrounding a payload chamber, and a temperature control insert operatively disposed between at least one of the insulative layers and the payload chamber.

The temperature control insert advantageously includes at least one phase change material (PCM) to assist in maintaining a desired temperature range within the payload chamber. In some embodiments described herein, the temperature control insert may include two or more phase change materials, or may include two or more distinct volumes of a single phase change material, e.g., that have been thermally conditioned prior to placement in the insulated container system. In one characterization, the temperature control insert comprises two or more volumes of the same PCM (or substantially similar PCMs) where the PCMs have substantially the same temperature before being placed in the insulated container, but have different thermal histories resulting in different phase states. For example, one volume of PCM could be a solid (e.g., "frozen"), while a second volume of the same PCM could be a super-cooled liquid at the same temperature. Further, the portion of the temperature control insert (e.g., the working surface) that is in thermal communication with the payload chamber may have a relatively high surface area to enhance the control over the temperature of the payload chamber.

Figure 1:
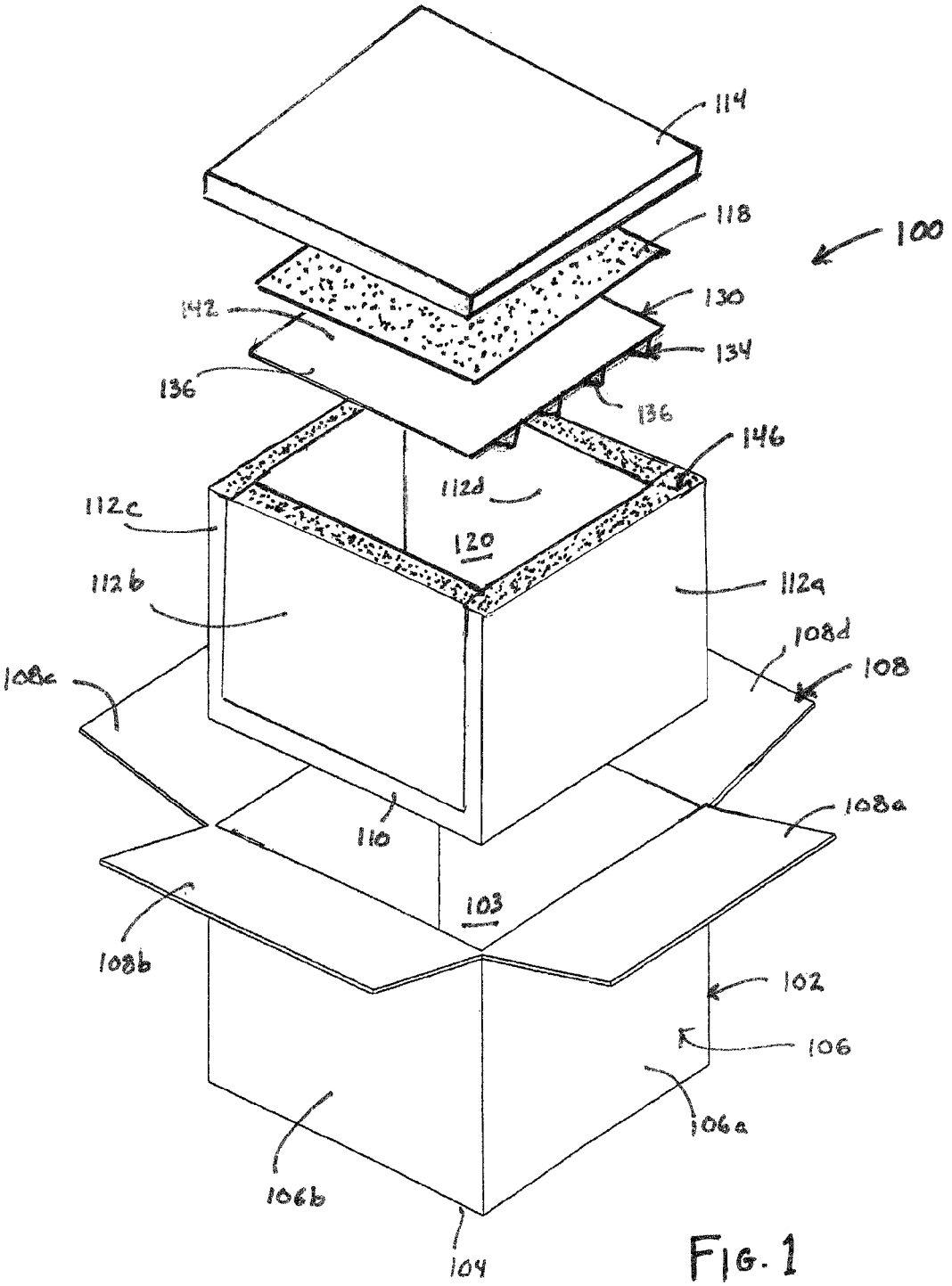
FIG. 1 illustrates an exploded view of an insulated container system including a temperature control insert.

Referring to FIG. 1, an exploded view of one embodiment of an insulated container system 100 is illustrated. The insulated container system 100 includes an external carton 102 in which the remaining components of the container system 100 may be operatively disposed. The external carton 102 includes a sidewall structure 106 comprising sidewall segments such as sidewall segments 106*a* and 106*b*, and extends from a bottom carton wall 104 to a top carton wall 108. As illustrated in FIG. 1, the external carton 102 is a regular slotted container (RSC) where the top wall 108 comprises several moveable (e.g., foldable) flaps, such as flaps 108*a*, 108*b*, 108*c* and 108*d*, that may be folded toward each other and sealed (e.g., using tape) after the insertion of the remaining components of the insulated container system 100 into the external carton 102. It will be appreciated that other types of external cartons such as clamshell-style cartons (e.g., with a single top flap for the top carton wall 108) may also be used with the insulated container system 100.

Although illustrated in FIG. 1 as a rectangular box having four distinct sidewall segments, it will be appreciated that the external carton may include a sidewall structure having more or fewer sidewall segments. For example, the external carton may be a cylindrical carton, e.g., where the sidewall structure comprises a cylindrical sidewall element. In one particular characterization, the external carton 102 comprises a corrugated cardboard box and the sidewall structure 106 comprises four sidewalls (e.g., sidewalls 106*a* and 106*b*). Even when the external carton is polygonal (e.g., 3 sidewalls or 4 sidewalls), the interior (e.g., the payload chamber) may be cylindrical, e.g., as defined by the internal components of the insulated container system, such as the insulative layers described below.

External carton 102 defines an enclosure 103, e.g., an enclosure bounded by interior surfaces of the carton 102, such as by the interior surfaces of the sidewall structure 106, the bottom carton wall 104 and the top carton wall 108. One or more insulative layers are operatively disposed within the enclosure 103. The insulative layers are placed within the external carton 102 to thermally insulate an inner portion of the carton 102, namely payload chamber 120, from the external environment, e.g., from the environment surrounding the external carton 102. In this regard, the insulative layers may be disposed along (e.g., adjacent to) each of the sidewall structure 106, the bottom carton wall 104 and the top carton wall 108 of the external carton 102.

As illustrated in FIG. 1, the insulative layers include a sidewall insulative layer 112 that includes sidewall insulative layer segments 112*a*, 112*b*, 112*c* and 112*d* that may be disposed adjacent to an interior surface of the sidewall structure 106. A bottom insulative layer 110 (e.g., adjacent bottom carton wall 104) is also provided to insulate the payload chamber 120 from the bottom of the carton 102. Thus, the payload chamber 120 is bounded by the sidewall insulative layer 112 and the bottom insulative layer 110. A top insulative layer 114 is operatively disposed over the payload chamber 120 to completely surround (e.g., completely insulate) the payload chamber 120. As illustrated in FIG. 1, the bottom insulative layer 110 is integrally formed with sidewall insulative layer segments 112*a* and 112*c*. In this manner, the number of individual insulative wall panels required to insulate the payload chamber 120 may be reduced (e.g., from 6 to 4) to simplify construction of the container system 100. In another characterization, the bottom insulative layer 110 may be integrally formed with the entire sidewall structure 112.

The insulative layers (e.g., sidewall insulative layer, top and bottom insulative layers) may include insulative materials such as expanded polystyrene (EPS), extruded polystyrene (XPS), polyurethane (PU), or high-performance insulating panels such as vacuum insulation panels (VIPs) or other panels having a high thermal resistance. VIPs or similar high-performance panels have a very low thermal conductivity and therefore can be utilized in thinner sections than, for example, EPS. In one characterization, one or more of the insulative layers 110, 112, 114 includes a high performance insulation panel, i.e., an insulation panel having a thermal resistance (thickness divided by thermal conductivity) of at least about 1.5 $m^2 \cdot K/W$. In another characterization, the high performance insulation panels may have a thermal resistance of at least about 2 $m^2 \cdot K/W$, or even at least about 3 $m^2 \cdot K/W$. As used herein, thermal resistance is the thermal resistance measured at a mean temperature of 20° C. Each of the insulative layers 110, 112, 114 may include the same insulative material and in one characterization each of the insulative layers includes a high-performance thermal insulation panel, such as a VIP. It will be appreciated that combinations of two or more insulation materials can also be utilized to form one or more of the insulative layers, e.g., EPS and a high performance insulation panel. In any event, it may be preferred that the insulative layers 110, 112, 114 have a thickness of not greater than about 50 mm, such as not greater than about 25 mm, to augment the useful volume in the payload chamber 120. High performance insulation panels such as VIPs are particularly suited for this purpose.

The container systems disclosed herein include a temperature control insert, e.g., that is configured to maintain a desired payload temperature for a period of time. As illustrated in FIG. 1 the temperature control insert 130 may be operatively disposed between the top insulative layer 114 and the payload chamber 120. The temperature control insert 120 includes a tray 134, the tray having a working surface 136, e.g., a heating and/or cooling surface, facing the payload chamber 120.

In this regard, at least a first phase change material ("PCM"), e.g., one or more PCMs, is disposed within (e.g., sealed within) the tray 134, e.g., adjacent the working surface 136. The tray 134 includes a peripheral edge portion 138 that is disposed around a central portion 142 of the tray 134. The edge portion 138 may be configured to be disposed between the upper edge(s) 146 of the sidewall insulative layer 112 and the top insulative layer 114 (e.g., a peripheral edge of the top insulative layer) so that the temperature control insert 130 may be firmly (e.g., compressively) engaged between the sidewall insulative layer upper edge 146 and the top insulative layer 114 when the system 100 is assembled. In this manner, the temperature control insert 130 will be resistant to movement during transport of the container system 100. The temperature control insert 130 is discussed in more detail below.

Although not illustrated in FIG. 1, the insulated container systems disclosed herein may comprise more than one temperature control insert, such as two temperature control inserts positioned on opposite sides of the payload chamber, e.g., one between the top insulative layer 114 and the payload chamber 120 and one between the bottom insulative layer 110 and the payload chamber 120. Further, although the temperature control insert 130 is illustrated as being disposed at the top of the payload chamber 120, it will be appreciated that a temperature control insert may be placed adjacent any side of the payload chamber 120, as well as the bottom of the chamber.

The insulated container system 100 may also include a first cushioning layer 116 that is disposed between the upper edge 146 of the sidewall insulative layer 112 and the outer peripheral edge 138 of the tray 134. Further, a second cushioning layer 118 may be disposed between the outer peripheral edge 138 and the top insulative layer 114, e.g., an outer edge of the top insulative layer 114. The use of the cushioning layers 116 and 118 may advantageously enhance the seal between the top insulative layer 114 and the temperature control insert 130, as well as the seal between the temperature control insert 130 and the sidewall insulative layer 112. The cushioning layers may be selected to be compressible and to reduce the possibility of leakage (e.g., of water vapor) into the payload chamber 120. Such cushioning layers may be fabricated from polymer foams such as a polyethylene (PE) foam or closed cell polyurethane (PU) foam, for example. In one characterization, the cushioning layers 116, 118, have a thickness of at least about 2 mm and not greater than about 12 mm in an uncompressed state.

Figure 2:
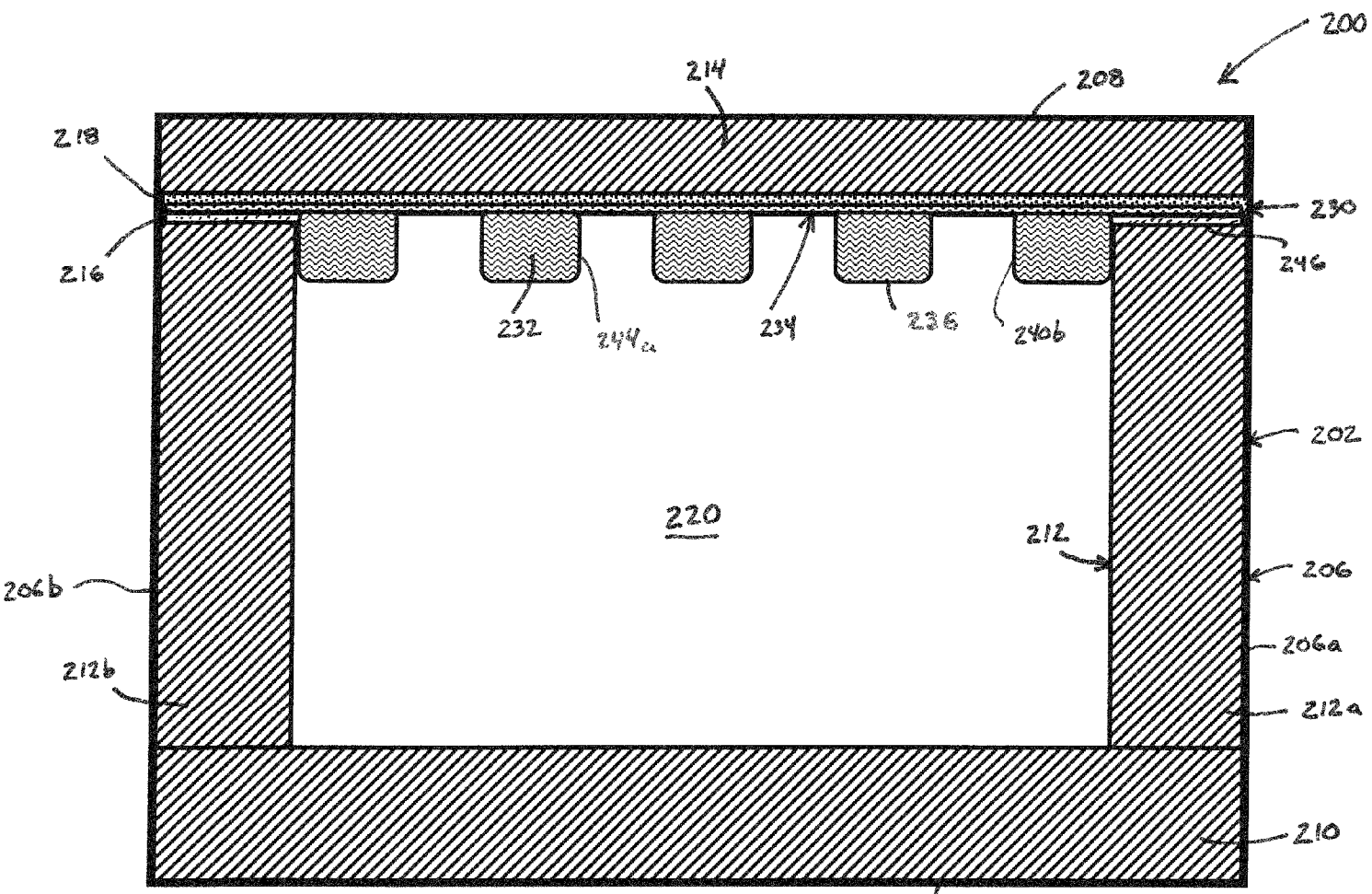
FIG. 2 illustrates a sectional view of an insulated container system including a temperature control insert.

FIG. 2 illustrates a cross-sectional view of an assembled insulated container system 200. The insulated container system 200 includes an external carton 202 having a bottom carton wall 204, a top carton wall 208 and a sidewall structure 206 extending from the bottom wall 204 to the top wall 208.

A sidewall insulative layer 212 is disposed within the external carton 202 and along (e.g., adjacent to) the sidewall structure 206 and thermally insulates a payload chamber 220 from the environment adjacent (e.g., exterior to) the sidewalls. A bottom insulative layer 210 is disposed along (e.g., adjacent to) the bottom wall 204 to thermally insulate the payload chamber 220 from the environment adjacent to the bottom wall 204. Thus, the payload chamber 220 is bounded by the sidewall insulative layer 212 and the bottom insulative layer 210.

A top insulative layer 214 is operatively disposed over the payload chamber 220 to insulate the payload chamber 220 from the environment adjacent the top carton wall 208. Thus, the insulative layers may completely surround and thermally insulate the payload chamber 220 from the external (e.g., ambient) environment. The payload chamber may advantageously have a volume of at least about 0.5 liters, such as at least about 1 liter. For many of the shipping applications contemplated herein (e.g., truck transportation and air transportation), the payload chamber may have a volume of not greater than about 150 liters, such as not greater than about 100 liters.

A temperature control insert 230 is operatively disposed between the top insulative layer 214 and the payload chamber 220. The temperature control insert 230 includes at least a first phase change material 232 that is disposed (e.g., sealed) within a tray 234. The tray 234 includes a working surface 236 that faces (e.g., is in thermal communication with) the payload chamber 220 to provide cooling and/or heating to the payload chamber 220.

To enhance the effectiveness of the temperature control insert 230 to provide adequate cooling and/or heating to the payload chamber 220, a portion (e.g., a first portion) of the working surface 236 extends into the payload chamber 220 by a greater distance than at least a second portion of the working surface 236. In this manner, the total surface area of the working surface 236 that is exposed to the payload chamber is increased and the effectiveness of the temperature control insert 230 is increased. That is, more of the working surface 236 and therefore more of the phase change material 232 is in thermal communication with the payload chamber 220. As illustrated in FIG. 2, at least a portion of the working surface 236 includes a plurality of projections (e.g., projection 244*a*) extending toward the payload chamber 220. The projections may advantageously increase the surface area of the working surface 236 that is exposed to the payload chamber 220. That is, due to the projections, the working surface 236 has a higher surface area than if the working surface 236 were substantially flat and planar on the side of the payload chamber 220. Further, as illustrated in FIG. 2, the working surface 236 is in direct thermal communication with the payload chamber 220, e.g., with no intervening layers that may impede the effectiveness of the insert 230 to cool/heat the payload chamber 220.

The insulated container system 200 may further include a first cushioning layer 216 disposed between an upper edge 246 of the sidewall insulative layer 212 and the temperature control insert 230, and a second cushion layer 218 that is disposed between the top insulative layer 214 and the temperature control insert 230, as is described with respect to FIG. 1.

The phase-change material 232 disposed within the temperature control insert 230 may be selected from a wide variety of phase-change materials or combinations of phase change materials (discussed below) depending on the application of the insulated container system, e.g., depending on the product being shipped within the payload chamber 220 and the thermal requirements for that product. There are a wide range of compounds and mixtures of compounds that may be useful as such phase-change materials to maintain a desired temperature range. Properties of the phase-change material that may be of importance (in addition to cost and safety) are transition temperature (i.e., melting temperature, or sublimation temperature for dry ice), the heat of melting (or sublimation) on both a mass and volume basis and the heat capacity. A few examples of such phase-change materials and their properties at sea level (e.g., 1 atm. pressure) are listed in Table I.

TABLE I

| Phase-Change Material | Transition and Temperature (° C.) | $\Delta H_m$ (J/g) | $\Delta H_v$ (J/cm$^3$) | $C_{p\text{-}liquid}$ (J/gK) |
|---|---|---|---|---|
| 23.3 wt. % NaCl/76.7% $H_2O$ (eutectic) | Solid-Liquid −21 | 235 | 275 | 3.32 |
| $H_2O$ (water) | Solid-Liquid 0 | 333 | 306 | 4.18 |
| $CO_2$ (dry ice) | Solid-Gas −78.5 | 571 | 799 | N/A |
| $C_{14}H_{30}$ (n-tetradecane) | Solid-Liquid 5 | 228 | 173 | 2.1 |
| $C_{16}H_{34}$ (n-hexadecane) | Solid-Liquid 16 | 237 | 184 | 2.1 |
| $C_3H_8O_8$ (glycerol) | Solid-Liquid 17 | 200 | 252 | 2.41 |
| $CaCl_2 \bullet 6H_2O$ (calcium chloride hexahydrate) | Solid-Liquid 29 | 171 | 256 | 1.45 |
| $Na_2SO_4 \bullet 10H_2O$ (sodium sulfate decahydrate) | Solid-Liquid 32 | 254 | 377 | 1.93 |
| $Na_2HPO_4 \bullet 12H_2O$ (disodium phosphate dodecahydrate) | Solid-Liquid 35 | 281 | 405 | 1.95 |
| $C_{20}H_{42}$ (n-eicosane) | Solid-Liquid 37 | 246 | 191 | 2.1 |

Thus, the phase change material may include organic compounds, inorganic compounds, salts, aqueous-based solutions, etc. and mixtures or combinations thereof. In one particular characterization, the phase-change material includes a gel, such as an aqueous-based gel comprising a salt (e.g., NaCl) dissolved in an aqueous medium. Such materials may advantageously mitigate issues with respect to safety that are often presented by the use of other materials such as dry ice ($CO_2$).

In one embodiment, the phase-change material may have a composition that is selected to be non-stoichiometric, such as to provide more gradual cooling or heating. One example of a non-stoichiometric phase change material is a hydrated salt such as hydrated sodium sulfate (e.g., $Na_2SO_4.xH_2O$, where x>10). In this regard, as the temperature increases, the composition of the mixture ($Na_2SO_4.xH_2O$ plus $H_2O$) changes to regulate the cooling/heating. That is, when the total water content is greater than X=10, a binary mixture forms of the solid hydrated salt and the salt solution at temperatures less than the transition temperature. Depending upon the temperature, the relative fractions of hydrated salt and water change so that a gradual change of transition temperature (and therefore energy release/generation) can be controlled, as compared to a transition temperature at a single discrete point.

Figure 3:
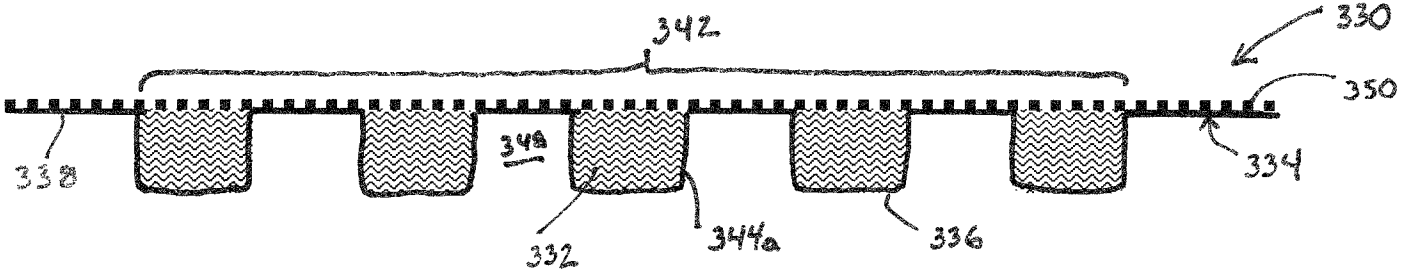
FIG. 3 illustrates a sectional view of a temperature control insert.
Figure 4:
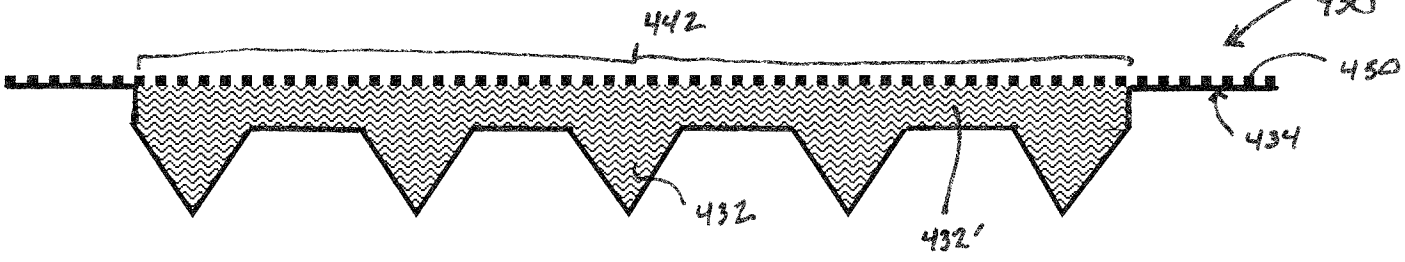
FIG. 4 illustrates a sectional view of a temperature control insert.

Turning to FIGS. 3 and 4, cross-sectional views of several embodiments of a temperature control insert are illustrated. As illustrated in FIG. 3 the temperature control insert 330 includes a tray 334 having a working surface 336 having a plurality of projections (e.g., projection 344*a*) that each include a phase-change material 332 disposed within the projection. The projections define channels (e.g., channel 348) between adjacent projections. As illustrated in FIG. 3 the tray 334 is configured such that the phase-change material 332 is disposed only within the projections, e.g., only within those portions of the working surface 336 that project inwardly toward the payload chamber (FIG. 2). That is, the central portion 342 of the temperature control insert 330 is substantially devoid of phase-change material 332 above the channels 348. The peripheral edge portion 338 substantially surrounds a periphery of the central portion 342, whereby the edge portion 338 is sufficiently thin to be readily compressed and sealed against the other components of the insulated container system (FIG. 2). In this regard, the edge portions 338 may be substantially devoid of phase-change material 332. Disposed over the tray 334 is a barrier layer 350 that is configured to seal the phase-change material 332 with the tray 334. Although illustrated as extending entirely over the peripheral edges 338 and the central portion 342 of the tray 334, the barrier layer 350 may extend over only a portion of the tray 334, such as only over the central portion 342. In one configuration, the barrier layer 350 is sealed to the tray 334 along the peripheral edge 338. The barrier 342 may be substantially liquid impermeably and vapor impermeable. In some embodiments, such as when dry ice is utilized as a phase change material 332, at least a portion of the barrier layer 350 may be vapor permeable to permit vapor to escape from the temperature control insert 330.

In the embodiment illustrated in FIG. 4 the central portion 442 of the temperature control insert 430 comprises an upper cavity 452 between the barrier layer 450 and the tray 434 that contains phase-change material 432'. The phase-change material 432' disposed within the upper cavity 452 may or may not be the same as a phase-change material 432 that is disposed within the projections 440. Further, the phase-change material 432' may or may not be in fluid communication with the phase-change material 432 disposed within the projections. Thus, in one characterization, the phase-change material 432' disposed within the upper cavity 439 is different than the phase-change material 432 disposed within the projections 440. The phase-change material 432' may have a transition temperature that is different than the transition temperature of the phase-change material 432. For example, at ambient temperature (e.g., about 25° C.), one phase-change material may be in a substantially solid state (e.g., to provide cooling to reach a desired lower temperature limit) while the other phase-change material may be in a liquid state (e.g., to provide heating to maintain a desired upper temperature limit).

In any of the configurations of the temperature control inserts disclosed herein, the tray may be formed (e.g., thermoformed) from a plastic sheet. For example, the working surface, including any projections, may be thermoformed to form a structure that is sufficiently stiff or rigid (e.g., rigid or semi-rigid) to be supported along its outer edges (e.g., by sidewall insulative layers—see FIG. 2) without substantially bowing inwardly toward the payload chamber under the weight of the phase-change material. In one example, the working surface has a thickness of at least about 0.1 mm, such as at least about 0.5 mm to provide sufficient rigidity. In one characterization, at least the bottom surface is thermoformed from plastic sheet such as polyethylene terephthalate (PET). The barrier layer may comprise a film (e.g., a gas and/or vapor impermeable film) that is placed over the thermoformed tray and sealed along the edges, such as with an adhesive, a heat seal layer or other methods known to those skilled in the art.

The depth of the projections (e.g., the amount the projections extend inwardly toward the payload chamber—see FIG. 2) may be selected to adjust the thermal cooling/heating properties of the temperature control insert. In one characterization, the projections have a depth of at least about 10 mm and not greater than about 50 mm.

Figure 5:
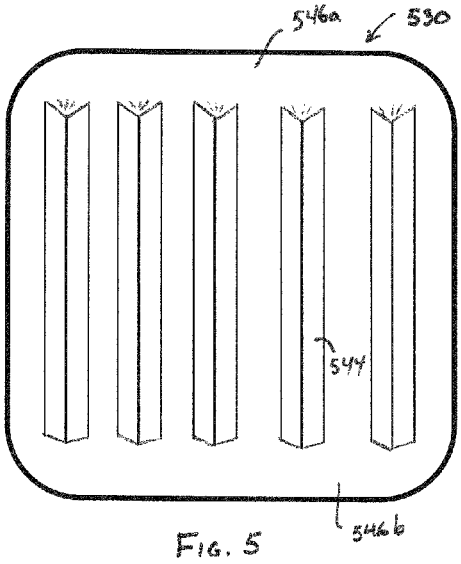
FIG. 5 illustrates a bottom view of a temperature control insert.
Figure 6:
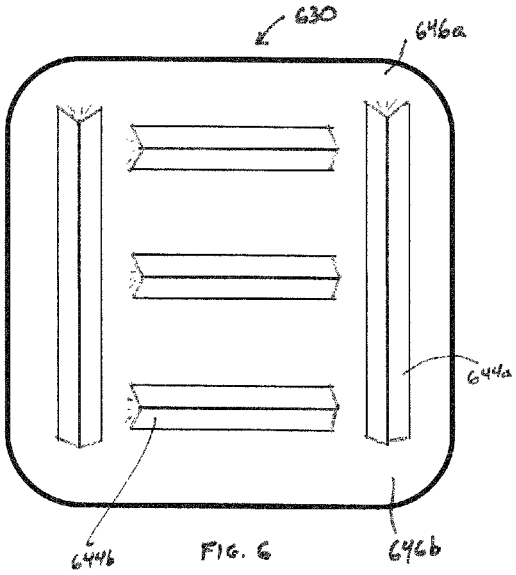
FIG. 6 illustrates a bottom view of a temperature control insert.

FIGS. 5-8 illustrate bottom views of various embodiments of a temperature control insert having different configurations for the projections. For example, the temperature control insert 530 includes a plurality of triangular projections 544 (i.e., triangular cross-section) that are disposed in substantially parallel relation from near a first edge portion 546*a* (e.g., a top edge) to near a second edge portion 546*b* (e.g., a bottom edge). In the embodiment illustrated in FIG. 6 the temperature control insert 630 includes first projections 644*a* that extend from near a top edge 646*a* to near a bottom edge 646*b*, and a plurality of second projections 644*b* that are disposed substantially perpendicular to the first projections 644*a*. Triangular cross-sections for the projections as illustrated in FIGS. 5 and 6 may be advantageous when the lower surface of the tray is thermoformed.

Figure 7:
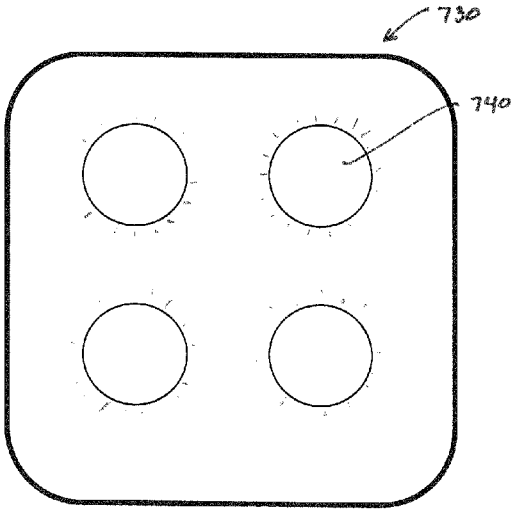
FIG. 7 illustrates a bottom view of a temperature control insert.
Figure 8:
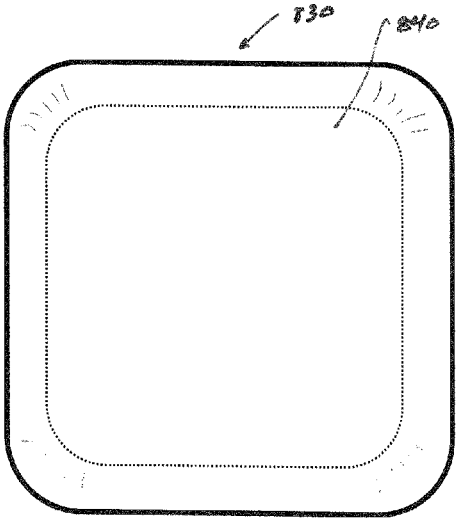
FIG. 8 illustrates a bottom view of a temperature control insert.

In the embodiment illustrated in FIG. 7, the temperature control insert 730 includes a plurality of discrete round (e.g., circular) projections 740 that extend inwardly. In the embodiment illustrated in FIG. 8, temperature control insert 830 includes a single surface forming a single "projection" 840. However, the embodiment of FIG. 8 may not be preferred for some applications due to the lower relative surface area provided by the single projection 840*d*. It will be appreciated that the configuration illustrated in the figures are merely exemplary, and one of skill in the art will realize that many other configurations are possible.

In this regard, the working surface of the temperature control insert (e.g., the surface that is thermally exposed to the payload chamber) may have an increased surface area as compared to a similarly configured temperature control insert that includes a flat and planar surface adjacent to the payload chamber. The ratio of the actual surface area of the working surface of the temperature control insert (i.e., including the surface area of the projections) to the geometric surface area if the working surface were flat and planar is referred to herein as the "surface area factor." In one characterization, the temperature control insert has a surface area factor of at least about 1.05, such as at least about 1.1, and even at least about 1.2. The surface area factor may be selected for a particular application depending on the desired temperature range within the payload chamber and the desired time to maintain the temperature range, for example.

Thus, the structure of the temperature control tray (e.g., the depth and quantity of projections) and the phase-change material(s), as well as the thermal resistance of the insulative layers, may be selected to maintain a variety of temperature ranges. In one characterization, the structure and materials are selected to maintain a payload temperature of about 2° C. to 8° C. for up to about 48 hours, such as up to about 72 hours or even up to about 96 hours or even up to about 120 hours. In another characterization, the structure and phase-change materials are selected to maintain an ambient temperature range (controlled room temperature or "CRT"), such as from about 15° C. to about 30° C. for similar time periods. In yet another characterization, the temperature range is maintained at or near human body temperature (e.g., about 37° C.) for similar periods of time. The range may also simply specify a minimum temperature or a maximum temperature, such as an application where the payload chamber must stay below a certain maximum temperature, such as below 0° C.

The insulated container systems described herein provide many advantages as compared to known insulated containers, such as for shipping goods. The use of the disclosed temperature control insert in combination with high performance insulation has been unexpectedly found to eliminate the need for coolant symmetry. That is, a uniform temperature can be maintained in the payload chamber while using a single temperature control insert, e.g., disposed along a single side of the payload chamber. Further, the structure of the temperature control insert enables the insert to be substantially stationary, even if the container is roughly handled during transport. The insert also maintains a constant surface area (e.g., area of the lower surface), even as the phase change material changes state, to yield predictable and repeatable chamber temperatures and temperature durations. The insert may also reduce or eliminate the need for the use of dry ice in many applications. Dry ice is considered to be a safety hazard and many transportation companies apply a surcharge for its use.

As is noted above, the temperature control insert may include a single PCM, two or more PCMs, and/or two or more distinct volumes of a single PCM that have been thermally conditioned to the same temperature prior to placement in the insulated container and shipment of the container, but where one volume of the PCM is a solid and another volume is a super-cooled liquid, e.g., where the volumes of PCM have different phase states. The selection of PCMs will depend upon various factors, including whether the goods within the insulated container are to be protected from temperature excursions in one direction (e.g., to keep frozen or prevent from freezing), or are to be protected from temperature excursions in both directions, e.g., to maintain a specified temperature range such as 15° C. to 30° C. Another factor is the ambient temperature profile that the container will be subjected to in its shipping lane.

For controlled temperature with protection from temperature excursions in both directions, i.e., cold and hot side protection, the selection of PCM(s) and their thermal conditioning is more critical. A prior art example is for 2° C. to 8° C. CTP application when using ice/water (e.g., gel packs) as the PCM. In this case, some of the PCM may be frozen (0° C. or lower when removed from the freezer) and some of the PCM may be thermally conditioned at a refrigerated temperature (e.g., about 5° C.). The quantity and location of each of the volumes of the water-based PCM must be carefully selected so if the outside ambient is cold, the conditioned water will freeze generating heat. Conversely, if the outside is warm, the ice will melt to cool the payload chamber. This approach requires two separate conditioning chambers (freezer and refrigerator) as well as a system design which has the correct mass and exposed surface area of both frozen and conditioned gel packs. This requirement of two conditioning temperatures and separate placement in the container complicates system design as well as increases labor cost and possibility of errors during packing of the container.

Unlike the ice/water example above, it is possible to use a single PCM with a transition temperature within the target temperature range, for example a melting point of about 5° C. for a 2° C. to 8° C. target range. Such PCMs may be thermally conditioned in a 5° C. chamber for an amount of time to partially freeze them or, alternatively, leave some in a 5° C. chamber for a long time (i.e., such that they are frozen) and the remainder in a 5° C. chamber to cool them to 5° C. without freezing. In practice, these approaches may suffer from reproducibility, quality, and cost issues.

In accordance with certain embodiments of the systems disclosed herein, two or more phase-change materials may be used within the insulated container, such as in a temperature control insert as described above. In accordance with other embodiments, a single phase-change material in two different states (e.g., a volume in the frozen state and a volume in the liquid state) may be utilized. These embodiments may be implemented using any configuration of temperature control insert, including but not limited to the inserts illustrated in FIGS. 5 to 8.

Figure 9:
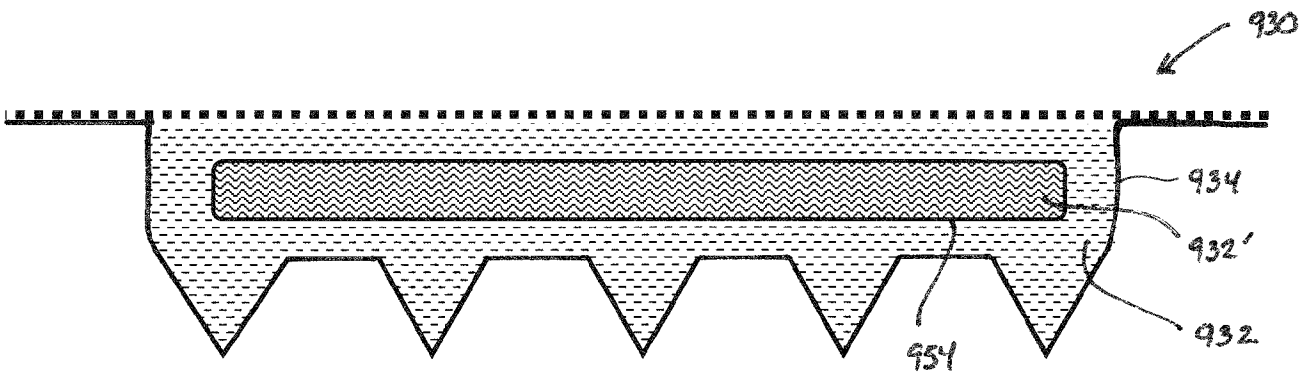
FIG. 9 illustrates a sectional view of a temperature control insert including a phase-change material.

FIG. 9 illustrates a cross-section of a temperature control insert 930 that includes a first phase change material 932 and a second phase change material 932' disposed within a tray 934. As illustrated in FIG. 9, first phase change material 932 is a liquid PCM at the starting temperature (e.g., when placed into the insulated container) and the second phase change material 932' is disposed within (e.g., is surrounded by) the first PCM 932. For example, the solid second phase change material 932' may be placed within a sealed package 954 (e.g., a sealed plastic pouch). In this manner, the volume of second phase change material 932' is physically segregated from the volume of first phase change material 932 (e.g., the volumes are discrete).

Figure 10:
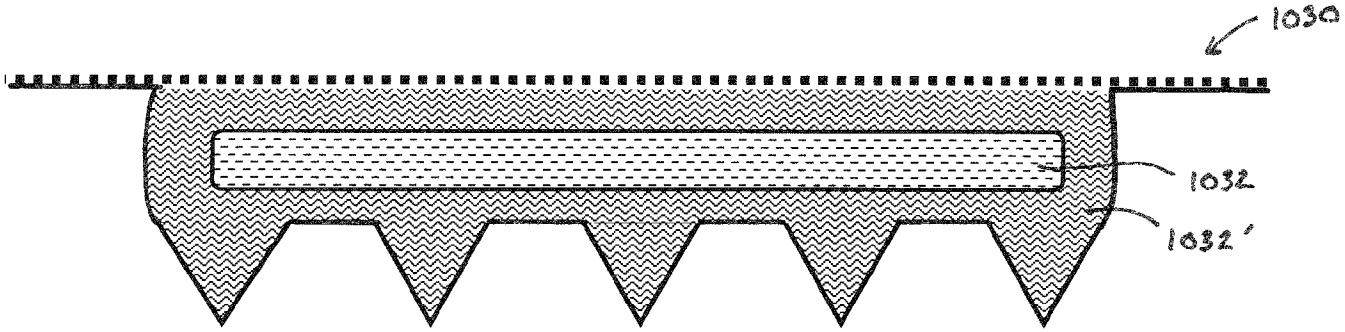
FIG. 10 illustrates a sectional view of a temperature control insert including a phase-change material.

As illustrated in FIG. 10, a volume of first phase change material 1032 is surrounded by a volume of second PCM material 1032' at the starting temperature, wherein the first phase change material 1032 is a liquid at the starting temperature and the second phase change material 1032' is a solid at the starting temperature. In either of the embodiments illustrated in FIGS. 9 and 10, the temperature control insert may be thermally conditioned before use (e.g., before placement into the insulated container system) such as by heating the insert above ambient or cooling the insert to below ambient. By selecting the first and second PCMs and their relative volumes, and selecting the starting temperature of the insert, a range of thermal conditions can be maintained within the insulated container.

The two or more PCMs do not have to be configured in the manner illustrated in FIGS. 9 and 10. For example, one PCM material may be placed within the projections, and a second PCM material may be placed within the upper cavity. Further, the two PCM materials could be placed in different projections, i.e., such that a portion of the projections contain a first phase change material and a second portion of the projections contain a second phase change material.

Figure 11:
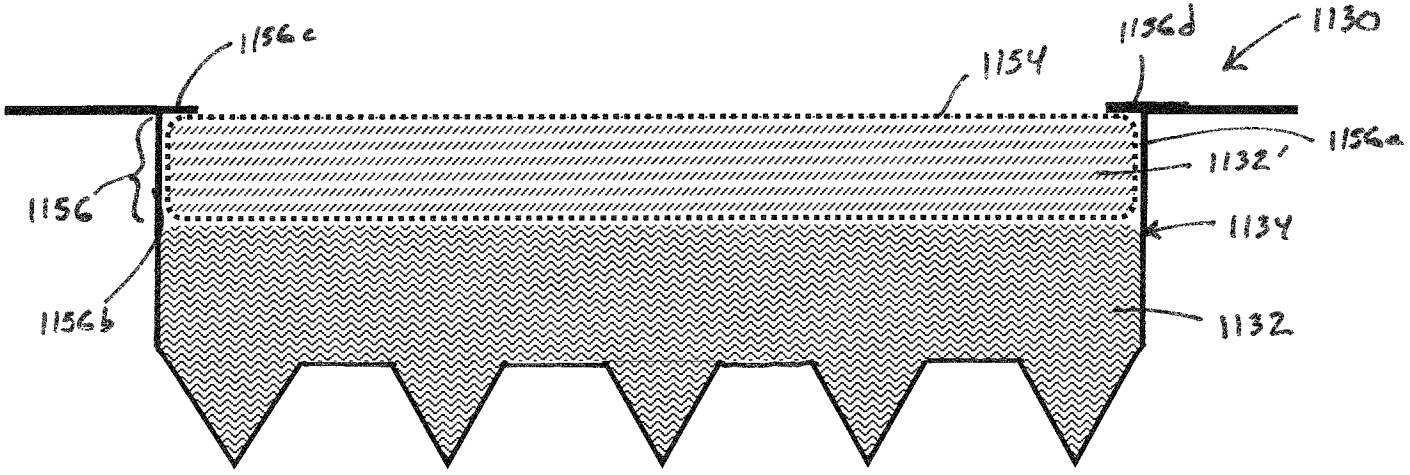
FIG. 11 illustrates a cross-section of an embodiment of a temperature control insert including an open tray portion above a sealed portion.

FIG. 11 illustrates a cross-section of an alternative embodiment of a temperature control insert 1130. As is illustrated in FIG. 11, the temperature control insert 1130 includes a tray 1134 containing a first phase change material 1132 sealed within the tray 1134. Disposed in an upper portion of the tray 1134 is an open (e.g., exposed) tray portion 1156 containing a second phase change material 1132', such as dry ice, disposed within the tray portion 1156. The open tray portion 1156 may be defined by side portions 1156*a* and 1156*b* and by lips 1156*a* and 1156*b* to contain the PCM 1132' within the upper tray portion 1156. In this manner, the dry ice can sublimate and provide cooling to the insulated container, where the amount of dry ice is selected such that the dry ice sublimes before the insulated container arrives at its destination, thereby reducing the risk associated with exposure of dry ice to the recipient. Once the dry ice has sublimated (e.g., during shipment), the cooling of the payload chamber can then be taken over by the first phase change material 1132 disposed within the tray 1134. In one characterization, the second PCM 1132' is dry ice and the first PCM 1132 is an aqueous gel, such as an aqueous gel having a transition temperature of not greater than about −20° C.

While various embodiments of the present invention have been described in detail, it is apparent that modifications and adaptations of those embodiments will occur to those skilled in the art. However, is to be expressly understood that such modifications and adaptations are within the spirit and scope of the present invention.

What is claimed is:

1. An insulated container system for maintaining a controlled payload temperature over a period of time, the insulated container system comprising:

an external carton comprising a sidewall structure extending from a bottom carton wall to a top carton wall and defining an enclosure bounded by the sidewall structure, the bottom carton wall and the top carton wall;

a sidewall insulative layer disposed within the enclosure and along the sidewall structure;

a bottom insulative layer disposed within the enclosure and along the bottom carton wall;

a payload chamber bounded by the sidewall insulative layer and bottom insulative layer;

a top insulative layer operatively disposed over the payload chamber; and a temperature control insert disposed between the top insulative layer and the payload chamber, wherein the temperature control insert comprises a tray and at least a first phase change material that is sealed within the tray, the tray having a working surface facing the payload chamber, the working surface having a first portion defining a top surface of the payload chamber and at least a second portion that extends from the top surface and into the payload chamber.

2. The insulated container system recited in claim 1, wherein the external carton comprises a corrugated cardboard box.

3. The insulated container system recited in claim 1, wherein the external carton is a regular slotted container (RSC).

4. The insulated container system recited in claim 1, wherein the sidewall structure comprises four sidewall elements.

5. The insulated container system recited in claim 1, wherein the sidewall insulative layer comprises a high performance insulation panel having a thermal resistance of at least about 1.5 $m^2 \cdot K/W$.

6. The insulated container system recited in claim 1, wherein the bottom insulative layer comprises a high performance insulation panel having a thermal resistance of at least about 2 $m^2 \cdot K/W$.

7. The insulated container system recited in claim 1, wherein at least one of the sidewall insulative layer and the bottom insulative layer comprises a vacuum insulation panel.

8. The insulated container system recited in claim 1, wherein the top insulative layer comprises a vacuum insulation panel.

9. The insulated container system recited in claim 1, wherein the working surface comprises a rigid or semi-rigid thermoformed structure.

10. The insulated container system recited in claim 9, wherein the working surface is fabricated from a plastic sheet.

11. The insulated container system recited in claim 10, wherein the working surface is fabricated from polyethylene terephthalate (PET).

12. The insulated container system recited in claim 1, wherein the second portion comprises a plurality of projections extending into the payload chamber.

13. The insulated container system recited in claim 12, wherein the projections extend into the payload chamber by a depth of at least about 10 mm.

14. The insulated container system recited in claim 1, wherein the working surface has a surface area factor of at least about 1.05.

15. The insulated container system recited in claim 1, wherein the first phase change material comprises an aqueous-based gel.

16. The insulated container system recited in claim 1, wherein the first phase-change material has a transition temperature of not greater than about 0° C.

17. The insulated container system recited in claim 1, wherein the first phase-change material has a transition temperature of not greater than about −20° C.

18. The insulated container system recited in claim 1, wherein the first phase change material has a transition temperature of at least about 5° C.

19. The insulated container system recited in claim 1, wherein the phase change material has a transition temperature of at least about 15° C.

20. The insulated container system recited in claim 1, wherein the phase change material has a transition temperature of at least about 25° C.

21. The insulated container system recited in claim 1, further comprising at least a second phase change material that is sealed within the tray.

22. The insulated container system recited in claim 1, wherein the temperature control insert comprises an outer peripheral edge that is disposed between an upper edge of the sidewall insulative layer and the top insulative layer to secure the temperature control insert therebetween.

23. The insulated container system recited in claim 22, further comprising a first cushioning layer disposed between the upper edge of the sidewall insulative layer and the outer peripheral edge of the temperature control insert.

24. The insulated container system recited in claim 23, further comprising a second cushioning layer disposed between the outer peripheral edge of the temperature control insert and the top insulative layer.

25. The insulated container system recited in claim 24, wherein the first and second cushioning layers comprise a polymer foam.

26. A temperature control insert configured for placement in an insulated container, comprising:

a volume of first phase change material disposed within the insert; and a volume of second phase change material disposed within the insert that is discrete from the volume of first phase change material, wherein at least one of the composition or the phase state of the second phase change material is different than the first phase change material.

27. The temperature control insert of claim 26, wherein the first phase change material is a liquid at a starting temperature and the second phase change material is a solid at the starting temperature.

28. The temperature control insert of claim 27, wherein the first phase change material is a super-cooled liquid at the starting temperature.

29. The temperature control insert of claim 28, wherein the first and the second phase change materials are the same or substantially the same composition.

30. The insulated container system recited in claim 1, wherein the temperature control insert comprises an outer edge disposed between an upper surface of the sidewall insulative layer and the top insulative layer.

31. The insulated container system recited in claim 12, wherein the plurality of projections contain a second phase change material, and at least one of the composition or the phase state of the second phase change material is different than the composition or phase state of the first phase change material.

32. The temperature control insert of claim 26, wherein the volume of the first phase change material surrounds the volume of the second phase change material.

33. The temperature control insert of claim 26, wherein the first and second phase change materials are physically segregated within the insert.

34. The temperature control insert of claim 26, wherein the volume of first phase change material is located in an upper cavity of the temperature control insert and the volume of second phase change material is located in a lower cavity of the temperature control insert.

35. The temperature control insert of claim 26, comprising a tray, wherein the volume of first phase change material and the volume of second phase change material are sealed within the tray, the tray having a working surface facing the payload chamber, the working surface having a first portion defining a top surface of the payload chamber and at least a second portion that extends from the top surface and into the payload chamber.

36. The temperature control insert of claim 26, wherein the volume of first phase change material is located in a first plurality of projections extending from the temperature control insert and the volume of second phase change material is located in a second plurality of projections extending from the temperature control insert.

* * * * *